US010231900B2

(12) United States Patent
Murison

(10) Patent No.: US 10,231,900 B2
(45) Date of Patent: Mar. 19, 2019

(54) ELECTRO-MECHANICAL SEXUAL STIMULATION DEVICE

(75) Inventor: Bruce Murison, Ottawa (CA)

(73) Assignee: Standard Innovation Corporation, Ottawa, Ontario (CA)

( * ) Notice: Subject to any disclaimer, the term of this patent is extended or adjusted under 35 U.S.C. 154(b) by 1308 days.

(21) Appl. No.: 13/014,321

(22) Filed: Jan. 26, 2011

(65) Prior Publication Data

US 2011/0124959 A1 May 26, 2011

Related U.S. Application Data

(63) Continuation of application No. 11/795,066, filed as application No. PCT/CA2005/001916 on Dec. 19, 2005, now Pat. No. 7,931,605.

(30) Foreign Application Priority Data

Dec. 17, 2004 (CA) ..... 2491249

(51) Int. Cl.
*A61H 19/00* (2006.01)
*A61H 1/00* (2006.01)
*A61H 23/02* (2006.01)

(52) U.S. Cl.
CPC ..... *A61H 19/34* (2013.01); *A61H 19/40* (2013.01); *A61H 19/44* (2013.01); *A61H 19/50* (2013.01); *A61H 23/0254* (2013.01); *A61H 2201/5002* (2013.01); *A61H 2201/5015* (2013.01); *A61H 2201/5035* (2013.01); *A61H 2201/5038* (2013.01); *A61H 2201/5048* (2013.01); *A61H 2201/5097* (2013.01); *A61H 2205/086* (2013.01)

(58) Field of Classification Search
CPC ..... A61H 19/44; A61H 19/34; A61H 19/50; A61H 23/0263; A61H 23/02
USPC ..... 601/46, 49, 67, 69–72, 79–81, 84, 601/130–131, 135–138, DIG. 16; 600/38; D24/200, 214–215
See application file for complete search history.

(56) References Cited

U.S. PATENT DOCUMENTS

| | | | |
|---|---|---|---|
| 1,511,572 | A | 10/1924 | Marshall |
| 1,636,159 | A | 7/1927 | Unné |
| 2,234,982 | A | 3/1941 | Ross |
| 2,478,786 | A | 8/1949 | Smallen |

(Continued)

FOREIGN PATENT DOCUMENTS

| | | | |
|---|---|---|---|
| DE | 20106065 | U1 | 11/2001 |
| EP | 1 477 149 | A1 | 11/2004 |

(Continued)

OTHER PUBLICATIONS

Gore, Margaret. The Penis Book: An Owners Manual. St Leonards, NSW: Allen & Unwin, 1997.*

(Continued)

*Primary Examiner* — Michael J Tsai
*Assistant Examiner* — Christopher E Miller
(74) *Attorney, Agent, or Firm* — Vorys, Sater, Seymour and Pease LLP

(57) ABSTRACT

A device for use by a female for sexual stimulation comprising an inner arm dimensioned for insertion into a vagina, to contact the wall of the vagina at or near the G-spot, an outer arm dimensioned to contact the clitoris, and a resilient U-shaped member connecting the inner and outer arms.

67 Claims, 8 Drawing Sheets

(56) References Cited

U.S. PATENT DOCUMENTS

| | | | | | |
|---|---|---|---|---|---|
| 3,504,665 | A | | 4/1970 | Bakunin et al. | |
| 3,521,216 | A | | 7/1970 | Tolegian | |
| 3,554,184 | A | | 1/1971 | Habib | |
| 3,705,575 | A | | 12/1972 | Edwards | |
| 3,868,160 | A | | 2/1975 | Kersman | |
| 3,996,930 | A | * | 12/1976 | Sekulich | 601/137 |
| 4,135,826 | A | * | 1/1979 | Holm | A61H 23/0263 366/116 |
| D273,132 | S | | 3/1984 | Moloff | |
| 4,574,791 | A | | 3/1986 | Mitchener | |
| 4,878,489 | A | * | 11/1989 | Kamayachi | A61H 23/0263 601/72 |
| 5,041,077 | A | | 8/1991 | Kulick | |
| D338,964 | S | | 8/1993 | Tarjoto | |
| 5,460,597 | A | | 10/1995 | Hopper | |
| 5,573,499 | A | | 11/1996 | McAllister | |
| D384,156 | S | | 9/1997 | Kain | |
| 5,690,603 | A | * | 11/1997 | Kain | 600/38 |
| 5,713,833 | A | | 2/1998 | Milligan | |
| 5,797,950 | A | | 8/1998 | Takashima | |
| 5,853,362 | A | * | 12/1998 | Jacobs | 600/38 |
| 5,861,000 | A | | 1/1999 | Takashima | |
| 5,871,533 | A | | 2/1999 | Boutos | |
| 6,010,471 | A | * | 1/2000 | Ben-Noon | 601/152 |
| 6,048,306 | A | | 4/2000 | Spielberg | |
| 6,053,881 | A | * | 4/2000 | Boodramsingh et al. | 601/70 |
| 6,132,366 | A | | 10/2000 | Ritchie et al. | |
| 6,179,775 | B1 | | 1/2001 | Thompson | |
| 6,183,426 | B1 | | 2/2001 | Akisada et al. | |
| 6,190,307 | B1 | | 2/2001 | Tsai | |
| 6,203,509 | B1 | * | 3/2001 | Duboff | 601/70 |
| D447,809 | S | | 9/2001 | Gladieux | |
| 6,440,092 | B1 | * | 8/2002 | Leventhal et al. | 601/148 |
| 6,685,660 | B1 | | 2/2004 | Taverna et al. | |
| D490,529 | S | | 5/2004 | Yang | |
| 6,741,895 | B1 | | 5/2004 | Gafni et al. | |
| 6,802,850 | B1 | | 10/2004 | Takashima | |
| D507,654 | S | | 7/2005 | Gollnick et al. | |
| 7,001,317 | B2 | | 2/2006 | Marcotte | |
| 7,081,087 | B2 | | 7/2006 | Jannuzzi | |
| D527,109 | S | | 8/2006 | Nan | |
| 7,122,015 | B2 | | 10/2006 | Luettgen et al. | |
| 7,166,072 | B2 | | 1/2007 | Smith | |
| D536,458 | S | | 2/2007 | Nan | |
| D605,779 | S | | 12/2009 | Murison | |
| 7,931,605 | B2 | | 4/2011 | Murison | |
| 2002/0103415 | A1 | | 8/2002 | Manska et al. | |
| 2002/0188233 | A1 | | 12/2002 | Denyes | |
| 2003/0018285 | A1 | * | 1/2003 | Robbins et al. | 601/137 |
| 2003/0023139 | A1 | * | 1/2003 | Hartz | 600/38 |
| 2003/0073881 | A1 | | 4/2003 | Levy | |
| 2003/0097041 | A1 | | 5/2003 | Ritchie et al. | |
| 2003/0236477 | A1 | | 12/2003 | Huang | |
| 2004/0068213 | A1 | * | 4/2004 | Fujisawa | 601/70 |
| 2004/0186344 | A1 | * | 9/2004 | Jannuzzi | 600/38 |
| 2004/0230093 | A1 | * | 11/2004 | Marshall | 600/38 |
| 2004/0267173 | A1 | * | 12/2004 | Mangano | 601/57 |
| 2005/0192519 | A1 | * | 9/2005 | Crunick | 601/72 |
| 2005/0203335 | A1 | | 9/2005 | Stachon | |
| 2005/0272002 | A1 | * | 12/2005 | Chenvainu et al. | 433/80 |
| 2005/0273024 | A1 | * | 12/2005 | Nan | 601/71 |
| 2006/0069330 | A1 | | 3/2006 | Nan | |
| 2008/0009775 | A1 | | 1/2008 | Murison | |
| 2008/0027275 | A1 | | 1/2008 | Topolev | |

FOREIGN PATENT DOCUMENTS

| | | | |
|---|---|---|---|
| EP | 1 477 149 | B1 | 7/2009 |
| GB | 1222731 | | 2/1971 |
| GB | 2 375 714 | A | 11/2002 |
| GB | 3014549 | | 9/2003 |
| JP | 2004-313690 | A | 11/2004 |
| JP | 2005288079 | | 10/2005 |
| RU | 2005110502 | | 9/2005 |
| WO | 1995011646 | | 5/1995 |
| WO | 02/38100 | A2 | 5/2002 |
| WO | WO 02/38100 | A2 | 5/2002 |
| WO | WO 03/089071 | A2 | 10/2003 |
| WO | 2007041853 | | 4/2007 |

OTHER PUBLICATIONS

Translation for JP 2005-288079 (Year: 2005).*
Translation for Femipet Internet Archive Wayback Machine. (Year: 2004).*
Office Action issued in Chinese Patent Application No. 201110086645.8 dated Oct. 31, 2011.
Office Action issued in Australian Patent Application No. 2011202093 dated Dec. 9, 2011.
EPC Communication for Application No. 05 820 999.0.
English Machine Translation for WO 02/38100.
English Machine Translation for JP 2004-3136990.
International Search Report and Written Opinion for Int'l Appln. No. PCT/CA2005/001916.
Office Action Summary for Korean Appln. No. 10-2007-7015916.
European Communication for EP Application No. 05 820 990.0.
Communication from a foreign (Chinese) Patent Office for a counterpart foreign application, dated Mar. 29, 2013.
Communication from a foreign (Korean) Patent Office for a counterpart foreign application, dated Apr. 16, 2013.
Purr, Snuggle Puss Product Detail Page, http://www.mypurr.com/servlet/the-157/vibrators,-women,-pleasure,-vibration,/Detail (last visted Jan. 7, 2010).
Nine Parts Desire, Snuggle Puss Product Detail Page, http://www.ninepartsdesire.com/index.php?main_page=product_info&products_id=306 (last visted Jan. 7, 2010).
Barnhart et al. (Dec. 6, 2004) Contraception 70, p. 498-505.
Pretorius et al. (2002) Contraception 66, p. 443-451.
Schober Sep. (2004) Reconstructive Urology 94 p. 589-594.
Weber et al. (1995) Obstetrics & Gynecology 86(6) p. 946-949.
Barwick (2001) Public consultation on sexually explicit videos.
Callahan et al. (2000) Contraception 61, p. 205-215.
Dunn et al. (2002) J. Sex & Marital Therapy 28 p. 399-422.
Harding (2002) Arch Sexual Behaviour 31 p. 351-357.
Laumann et al. (1999) JAMA 281 p. 537-544.
Levin (2003) Sexual and Relationship Therapy 18(4) p. 509-513.
Sanders and Reinish (1999) JAMA 281 p. 275-277.
Solursh et al. (2003) International Journal of Impotence Research 15 Suppl 5 S-41-S45.
Suh et al. (Jun. 2004) J Psychosom Obstet Gynecol 25 p. 153-162.
Leaflets showing natural contours products (date uncertain).
Wayback of www.drleonards.com re: Ultime (Wayback archive dated Oct. 27, 2003).
The International Design Magazine "The naked truth" (Apr. 2001).
The Good Vibrations Guide to Sex: The Most Complete Sex Manual Ever Written; Cathy Winks and Anne Semans; Cleis Press, 2002; pp. 151, 157, 159 re: Natural Contours Ultime Vibrator.
Review of Rock Chick by users on http://www.sextoytesters.co.uk/reviews/rock_chick.shtml (Jun. 2004).
Description of Rock Chick device (date uncertain).
Publication of the Femipet product from a Wayback printout of: http://daimaoh.kir.jp/ro/femipet.htm and certified English translation of same (Wayback archive dated Jan. 12, 2004).
Website print-out from "www.sensualadviser.com/ . . . " re: Feeldoe Slim Blue (2005).
Review of Doc Johnson Savanna G-Spot Tickler by users on http://www.sextoytesters.co.uk/reviews/g-spot-tickler.shtml (Nov. 2005).
Wikipedia entry for the "Rabbit Vibrator" (May 8, 2012).
Wikipedia entry for the "Hitachi Magic Wand" (Apr. 30, 2012).
Website print-out of "www.treasuresforpleasure.com/ . . . " re : Golden Triangle U Send Me Dual Vibrator (date uncertain).
Online reviews of California Exotics Dual Penetrator Vibrator on a website print-out of "www.sextoy.com/ . . . " (Jun. 9, 2004).
Website print-out from "www.mylovemachine.com/ . . . " re : Gemini Probe (Nasswalk) (Jan. 1, 2000).

(56) References Cited

OTHER PUBLICATIONS

Website printout for "www.moonbonbon.com/ . . . " (in Japanese) re: Femme Fetale G-Spot Teaser Pleaser (Nasswalk) (date uncertain).
"Pink Pleasures" catalogue page re: Double Pleaser Jelly Bong and Wascally Wabbit (date uncertain).
Wayback of "www.sextoy.com . . . " re: Clitoral Dancer Massager (Wayback archive date Sep. 5, 2004).
Adam & Eve Catalogue re: Swan Song Vibrator (May 31, 2002).
Chivers et al. (Nov. 2004) Psychological Science 15, pp. 736-744.
Eisenman (2001) BMC Women's Health 1.1.
Pendergrass (2000) Gynecol Obstet Invest 50, pp. 54-59.
Pendergrass (2003) Gynecol Obstet Invest 55, pp. 110-113.
Schultz et al. (1999) BMJ 319, pp. 1596-1600.
Hines (2001) Am J Obstet Gynecol 185, No. 2, pp. 359-362.
Davis et al. (1996) The Journal of Sex Research 33, No. 4, pp. 313-320.
Reece et al. (May 2004) The Journal of Sex Research 41, No. 2, pp. 173-180.
Third Party Observations dated May 13, 2013 filed in respect of counterpart European application EP 05820999.0.
Third Party Observations dated Jun. 26, 2013, filed in respect of counterpart European application EP 05820999.0.
Office Action based on CA 2,684,004 dated Dec. 15, 2010.
EPO Communication dated Jan. 30, 2014 on EP 05820999.0.
Public Version of Initial Determination on Violation of Section 337 by Administrative Law Judge Thomas B. Pender of U.S. International Trade Commission (ITC) dated Feb. 8, 2013.
Public Version of Recommended Determination on Remedy and Bond by Administrative Law Judge Thomas B. Pender of U.S. International Trade Commission (ITC) dated Feb. 1, 2013.
Notice of Determination to Review Final Initial Determination dated Mar. 25, 2013.
Final Commission Determination of Violation; Issuance of a General Exclusion Order and Cease and Desist Orders; and Termination of the Investigation by Lisa R. Barton of U.S. International Trade Commission (ITC) dated Jun. 17, 2013.
Public Version of the Commission's Opinion by Lisa R. Barton of U.S. International Trade Commission (TIC) dated Jul. 12, 2013.
Correspondence from Lisa R. Barton of U.S. International Trade Commission (ITC); Corrected General Exclusion Order; Various Corrected Orders to Cease & Desist—dated Feb. 7, 2014.
[1] Cosmopolitan Magazine, Sex Advice Column, Natasha Burton, "A Brief History of the Rabbit," (Sep. 20, 2013).
[2] Description of Rock Chick on http://www.pinkcherry.com/rock-chick-vibe-in-purple (Jun. 3, 2012) with Declaration of Iona Kaiser dated May 28, 2014.
[3] Declaration of Anne Finlayson dated May 28, 2014.
[4] Anonymous: "Natural contours (Ultime, Superbe,Magnifique)", URL: https://webarchive.org/web/20020408114635/http://www.natural-contours.com discloses a female solo stimulation/muscle toning device for serving dual pleasure points (various/uncertain dates).
[5] Wayback of "Natural Contours" re: Ultime (Wayback archive date Mar. 28, 2002).
[6] Wayback re: Rock Chick device (Wayback archive date Nov. 25, 2004).
[7] Wayback re: Rock Chick device (Wayback archive date Jan. 18, 2005).
[9] Wayback re: Femipet device (Wayback archive date Jan. 12, 2004).
[10] Collection of documents re: Femipet device (various/uncertain dates).
[11] Wayback of "Clitoral Dancer" device (Wayback archive date Sep. 5, 2004).
[12] Wayback of "Climax Maximizer" device (Wayback archive date Jan. 20, 2004).
[18] Design Register excerpt 40405681-001.
[19] Wayback for Ultime, Superbe, Magnifique (2002).

* cited by examiner

ELECTRO-MECHANICAL SEXUAL STIMULATION DEVICE

CROSS-REFERENCE TO RELATED APPLICATIONS

This application is a continuation of U.S. patent application Ser. No. 11/795,066, filed Jul. 11, 2007, which is a submission under 35 U.S.C. § 371 for a U.S. national stage patent application of International Application Number PCT/CA2005/001916, filed Dec. 19, 2005, which is related to and claims priority to Canadian Patent Application Serial Number 2,491,249, filed Dec. 17, 2004, the entirety of each of which is incorporated herein by reference.

The present invention relates to the field of sexual paraphernalia. In particular, the present invention provides an electro-mechanical device for sexual stimulation intended for use by women either as an auto-erotic aid or during intercourse.

There are numerous devices available for use by women for sexual stimulation. They include products that are entirely manually operated, and achieve stimulation by shape and/or texture, and products that are provided with internal motors that achieve stimulation by shape, texture and vibration. These latter devices, commonly referred to as vibrators, are usually phallus shaped, and are provided with a handle for manipulation in and around the genital region by a woman. As such, they can generally be used to stimulate only one area at a time. However, it is known that there are at least three distinct effective genital stimulation areas in most women, namely the clitoris and surrounding skin, the inner surface of the vagina and the so-called G-spot, a nerve reflex area inside the vagina, along the anterior surface.

The applicant is aware of several devices that can be used to stimulate the G-spot, such as that shown in U.S. Pat. No. 5,853,362. This device is generally hook-shaped, so that if grasped by its shaft, can be inserted into a woman's vagina, and used to massage the G-spot area. Again, this type of device is effective for stimulating only one, and perhaps two (if one considers that stimulation of the G-spot will result in some stimulation of the vaginal wall) areas at a time. The device illustrated is U.S. Pat. No. 5,853,362 is, like many similar devices, of fairly hard surface construction.

US2004/0230093 A1 illustrates a device with a handle that is generally U-shaped with an inner arm terminating in a curve for stimulating the G-spot, and an outer arm with a gripping handle and a textured face for clitoral stimulation. The outer arm of the device may be provided with a cavity into which a small self-contained "bullet" shaped vibrator may be inserted. Essentially, then, this device may be used as a manually movable clitoral vibrator, with an arm extending into the vagina. No direct vibration means effective to stimulate the vagina or G-spot during intercourse are provided.

The present invention seeks to overcome the shortcomings of the prior art by providing a sexual stimulation vibrator appliance that is a significant advance over known vibrators. The vibrator of the present invention is designed to provide vibratory stimulation simultaneously to the clitoris, G-spot and vagina. Moreover, the vibrator of the present invention can be comfortably worn during intercourse unlike the devices of the prior art. The vibrator of the present invention is provided with an internal power source that provides power to two independently operating motors. Moreover, the motors can be operated to created a harmonic vibration in the entire device. The vibrator of the present invention, moreover, is provided with an internal skeleton of either molded plastic and/or pre-shaped metal (such as a memory alloy) so that use of a very soft silicone body will not result in an appliance that can't hold its shape.

In a broad aspect, then, the present invention relates to a device for use during intercourse by a female for sexual stimulation comprising an inner arm dimensioned for insertion into a vagina, to contact the wall of the vagina at or near the G-spot, an outer arm dimensioned to contact the clitoris, and a resilient U-shaped member connecting the inner and outer arms.

In an other broad aspect, then, the present invention relates to a sexual vibrator having a first arm including vibrating means, a second arm including vibrating means, and a slender generally U-shaped member connecting the two arms The inner arm, in a preferred form, terminates in a generally teardrop-shaped pad including a rounded inwardly directed protuberance.

The outer arm preferably widens from said U-shaped member to its extremity, and has a smooth inner surface adapted to contact the clitoris.

The device, may be provided with a resilient inner skeleton covered with a soft, pliable outer layer.

The outer arm defines a clitoral pad that is substantially rectangular, and tapers to meet the U-shaped member. It is of a width such that it may be tucked between the labia majora, in contact with the clitoris.

Moreover, preferably at least one of said inner and outer arms is provided with a vibratory motor.

Most preferably, each of said inner and outer arms is provided with a vibratory motor.

Accordingly, each device will be provided with power means.

The power means may a rechargeable battery. The rechargeable battery is located in said outer arm.

Accordingly, the outer arm includes an outlet for recharging said battery, and a recharging circuit.

Furthermore, the outer arm will be provided with switch means. The switch means is capable of actuating said motors in more than one on mode.

In a most preferred embodiment, the device has a silicone outer layer, and a resilient plastic inner skeleton.

In drawings that illustrate the present invention by way of example:

Figure 11A:
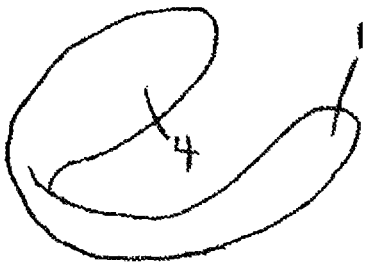
Figure 11B:
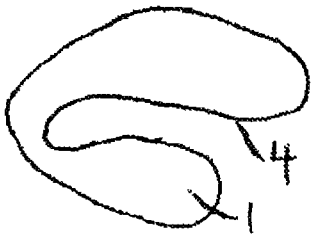
Figure 11C:
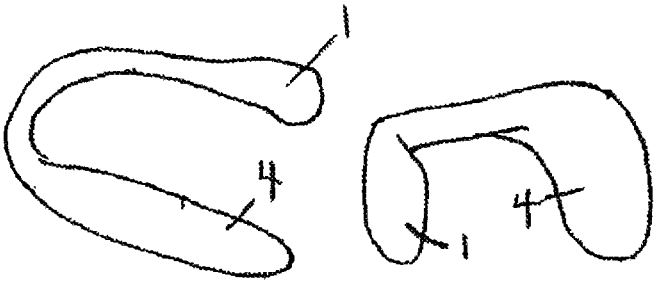
Figure 11D:
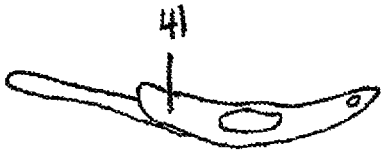
Figure 11E:
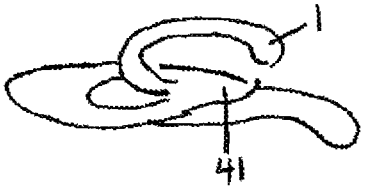
Figure 11F:
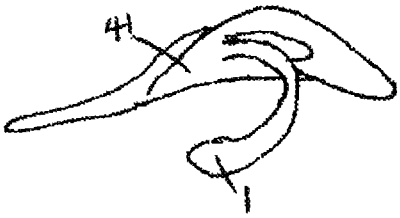
Figure 11G:
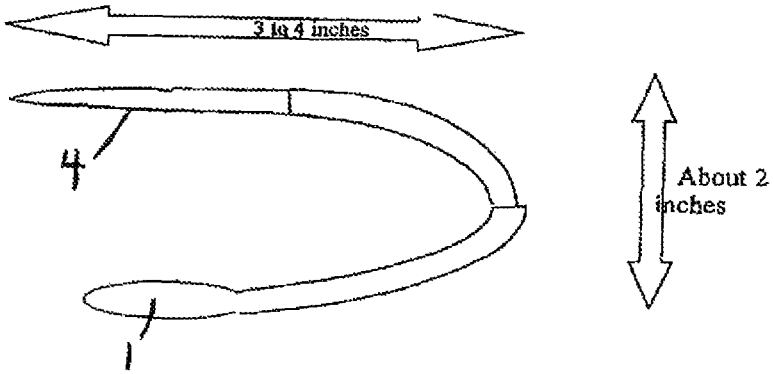
Figure 11H:
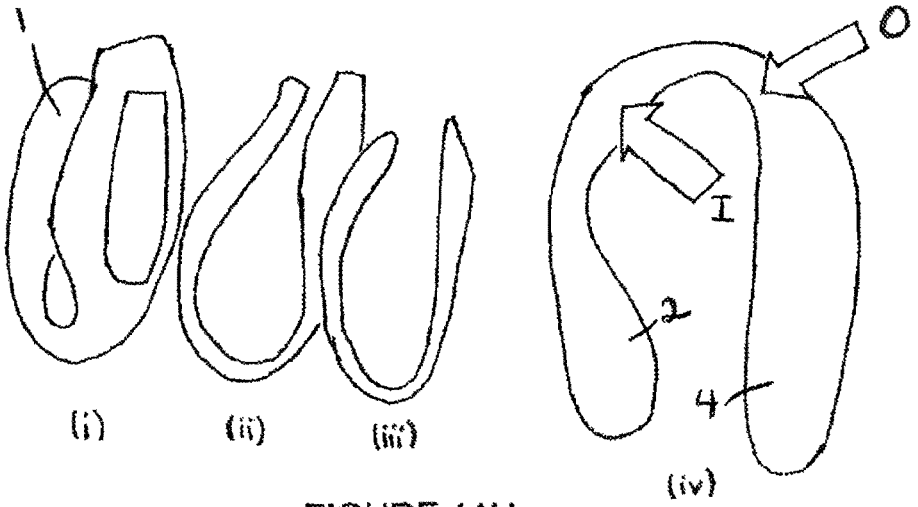
Figure 11I:
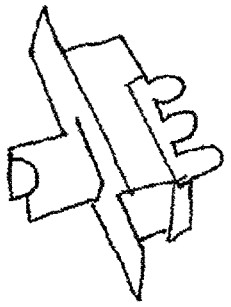
Figure 11J:
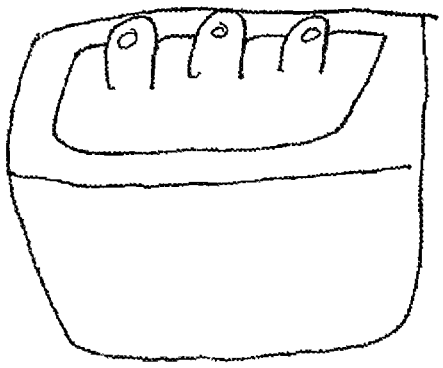
Figure 11K:
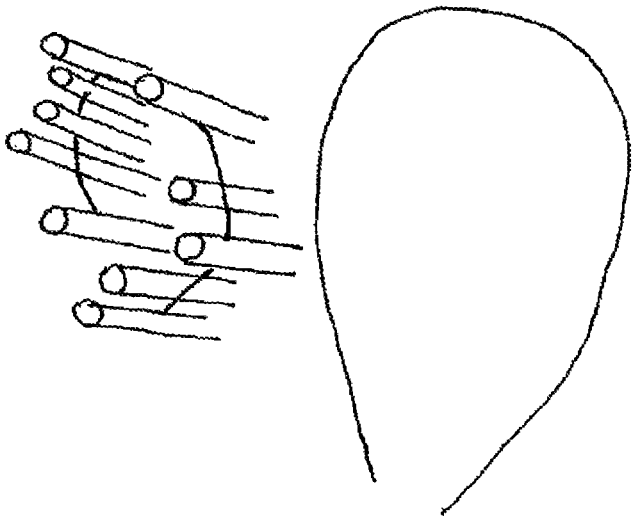
Figure 11L:
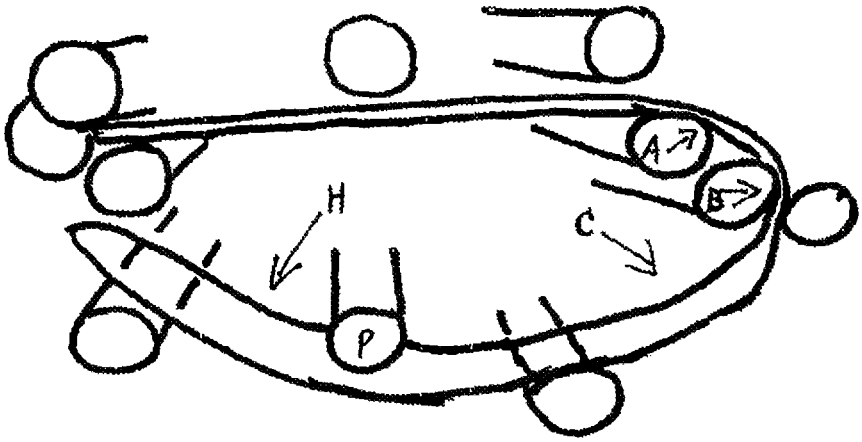
Figure 11M:
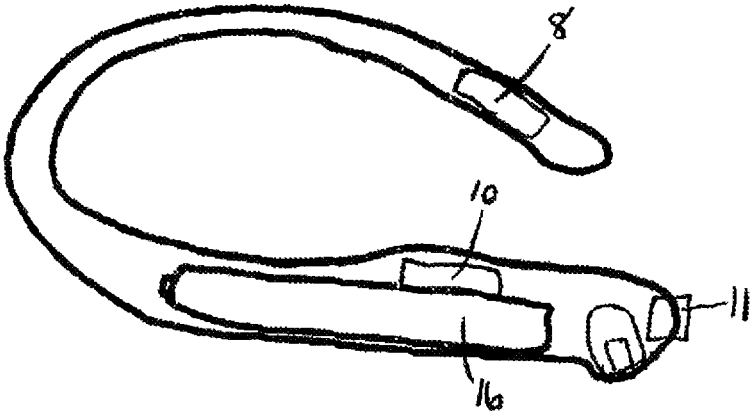
Figure 11N:
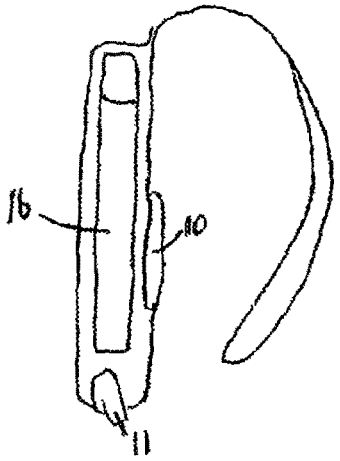
Figure 11O:
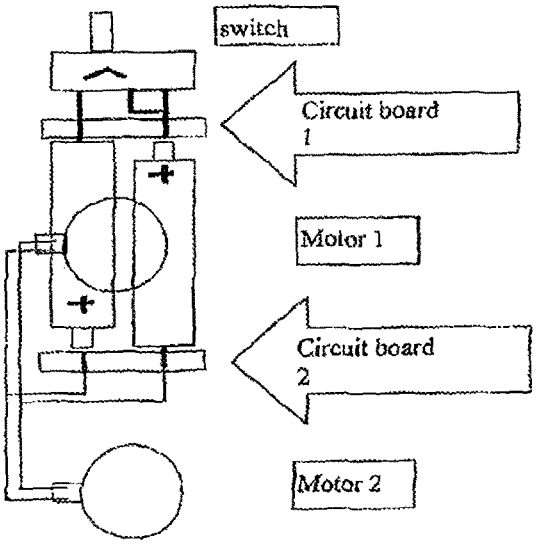

FIGS. 11*a* to 11*o* are a series of photographs and schematics showing details of alternate embodiments.

Figure 1:
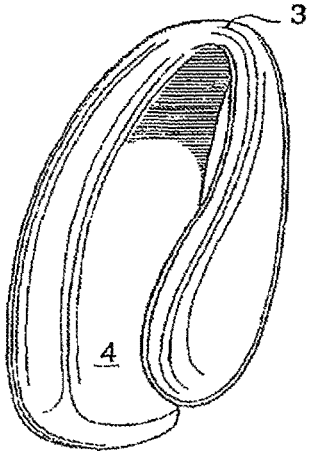
FIG. 1 is a perspective view of a first embodiment of the device of the present invention.
Figure 2:
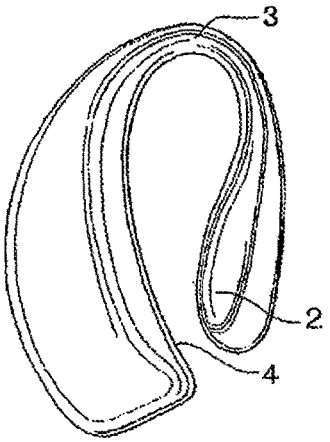
FIG. 2 is a side view of the device of FIG. 1.
Figure 4:
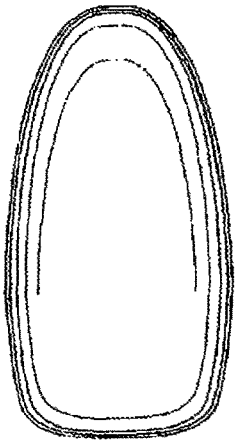
FIG. 4 is a front view of the device of FIG. 1.
Figure 5:
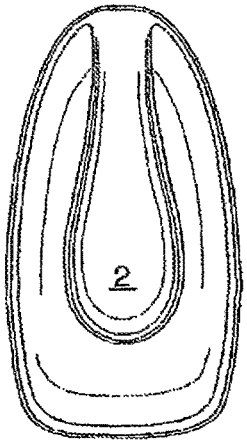
FIG. 5 is a rear view of the device of FIG. 1.
Figure 6:
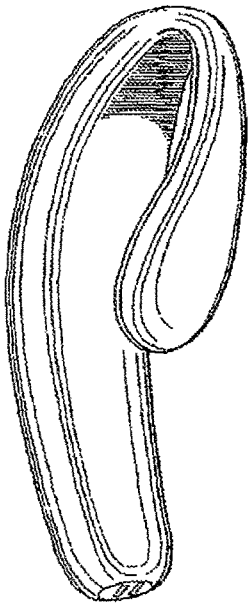
FIG. 6 is a perspective view of a second embodiment of the device of the present invention.

Referring now to FIG. 1, the present invention provides a vibrator/sexual stimulation device that is anatomically shaped, and very flexible. It is shaped to provide an inner arm 1 that terminates in a bulbous teardrop-shaped pad 2 especially visible from FIGS. 2 and 5. This pad is intended to lie against the region of the vagina near which the G-spot is located. Arm 1 narrows to a slender U-shaped transition portion 3 and then widens into a broad, flat clitoris stimulator pad 4. The clitoris stimulation pad 4 is fairly flat (as can be seen in FIG. 2), and dimensioned in width to fit within the labia majora (see FIG. 4). It will be understood, then, that in use, the clitoral pad 4 is tucked between the labia majora, against the clitoris, and will provide a direct vibration stimulus to the clitoris. The inner arm 1 meanwhile, is inside the vagina, drawn up against the G-spot, and also vibrating. Moreover, it will be understood that a harmonic pulsation will occur in the entire device due to the interaction between the vibrations produced by each motor.

It will also be noted that because the inner arm 1 is drawn forward in use and the U-shaped admittance arm or transition portion is quite thin and narrow, emplacement of the device will not interfere with ordinary sexual intercourse.

Figure 3:
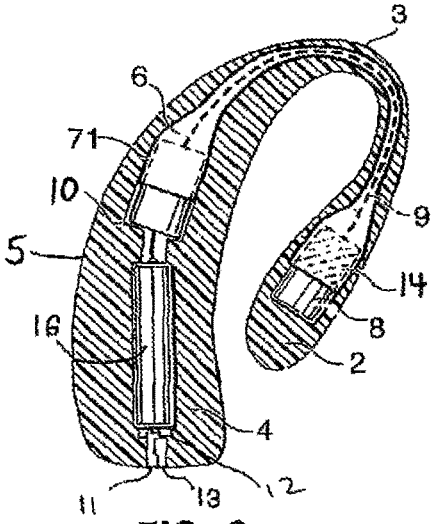
FIG. 3 is a cross-sectional view through line 3-3 of FIG. 2.

Referring now to FIG. 3, it will be observed that the device includes an outer skin 5 of silicone, vinyl, rubber, or other suitable material, and an inner core 6 comprising a skeletal core made from a shape memory alloy like Ti Ni, or from a less expensive material, such as a thermoplastic elastomer, or a moulded nylon or polyurethane shell. Core 6 must be flexible enough to withstand fairly vigorous use, resilient enough to consistently exert a forward pressure on the G-spot and hard enough to protect the components and circuitry located inside it. Located in a first shell 7 at the end of the inner arm 1 toward the tear-drop shaped G-spot pad 2, a longitudinally oriented first vibration motor 8, provided with a small rotating eccentric weight (not shown). Wiring 9 connects the first motor to a second motor 10 located in a shell 71 at the other end of the generally U-shaped core 6, and then further wiring connects two motors to a power source comprising a battery 16 such as an AA or AAA NiCd, a switch 11, preferably a three-position sliding switch, located near the end of the device so that it can be manipulated between an 'off' position and a pair of 'on' positions; and a recharging circuit 12 and outlet 13. As illustrated, recharging outlet 13 may be accessible from the outside, but it may be covered with a removeable plug. Alternately, recharging circuit 12 may be an induction recharger, not requiring metal to metal contact. It will be understood, moreover, that the number, orientation, and strength of the motors, will be a matter of choice to one skilled in the art. If desired, two or more motors may be provided at each end of the device, or only one motor at each end, or any combination. Furthermore, the switch may be provided with any number of 'on' settings to power any combination of the motors at the same or different levels or direction of rotation. This will create variable harmonic wave patterns in the device, so that a harmonic wave pattern pleasing to the user may be determined on an individual basis. Moreover, the switch may be a push button, a dial, or any other suitable type of switch. Furthermore, the shell component itself may be made from a bimetallic alloy 14 capable of 'twitching' upon application of a current, which may be applied in any desired pattern.

It will also be understood that the device of FIGS. 1 to 5 may be manufactured with a non-rechargeable battery, and so not be provided with a recharging circuit and outlet. Accordingly, the unit may be considered disposable after the battery is completely discharged. Alternatively, replaceable batteries may be used. In this case, the device should be provided with a re-sealable access means, such as a peel-back silicone layer, to access the batteries.

Referring now to FIGS. 6 to 10, a series of views similar to those shown in FIGS. 1 to 5 is illustrated, for a second embodiment of the device of the present invention. The principle difference in the two devices is that in the case of the second device, the clitoral pad is elongated, and formed as a handle for manual manipulation. The inner arm 1 is provided with first vibrator motor 8. It is not necessary that the wiring 9 to the inner arm motor be contained within the core 6 or shell 7, as it will be covered with a resilient layer of silicone or like material.

Figure 7:
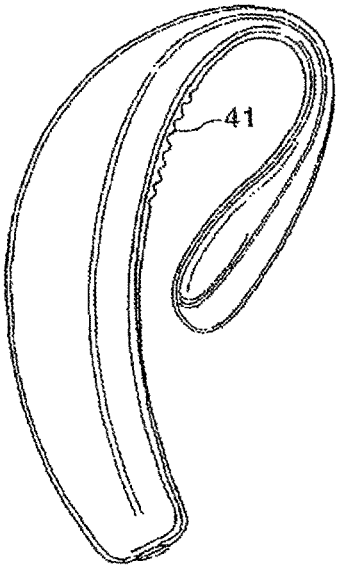
FIG. 7 is a side view of the device of FIG. 6, also showing a surface texturing in the clitoral stimulation area.
Figure 8:
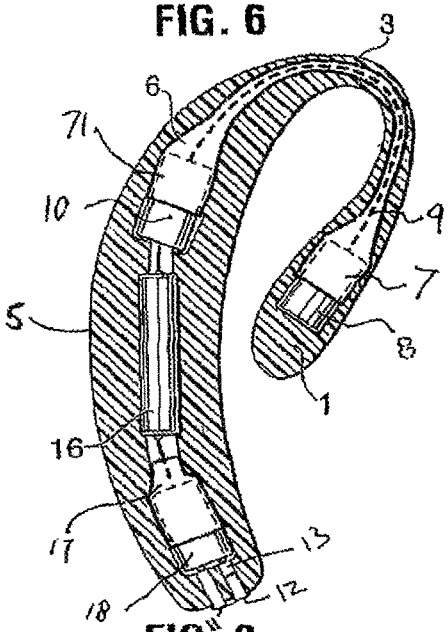
FIG. 8 is a cross-sectional view through line 8-8 of FIG. 7.
Figure 9:
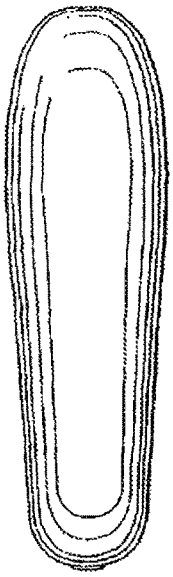
FIG. 9 is a front view of the device of FIG. 6.
Figure 10:
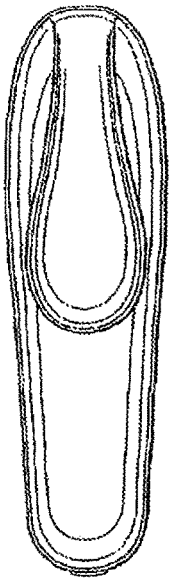
FIG. 10 is a rear view of the device of FIG. 6.

The core 6, as shown in FIG. 8, is embodied in the U-shaped curved portion 3 and terminates in the open-ended shell portion 71 containing a second vibrator motor 10. As can be seen from FIG. 8, the interior volume of the device is then occupied by a rechargeable battery 16, followed by a further open shell portion 17, housing a further vibrator motor 18, a recharge circuit/outlet, and switch. It will be understood that the shell portion may, if desired, be manufactured as one continuous piece, housing all three motors, the battery, the recharge circuit and the switch. As can be seen in FIG. 7, the inner wall of the device in the clitoral pad area 41 may be textured to provide enhanced stimulation.

Since three motors are used in the second embodiment of the device of the present invention, very substantial harmonic wave effects can be created by simultaneous activation of the motors.

It will be understood, moreover, that many variations of the device of the present invention are possible, without departing from the spirit of the invention.

Numerous variants and/or features of the device of the present invention and the method of manufacture are described in the following paragraphs, which refer to the photographs and schematics appended hereto as FIGS. 11*a* to 11*o*.

There are four proposed versions of the present invention:

"Lite", which is shaped like a "C", and in respect of which the preferred embodiment of FIGS. 1 to 5 above, has been described (and which is also illustrated in FIGS. 11*a*-11*c*);

"Medium", which is shaped like a "C", and has a small handle, and in respect of which the preferred embodiment of FIGS. 6 to 10 above, has been described;

"Full", which is made of the "Medium" version, plus has two vibrating membrane arms that come from the central part of the "C" and cover the labia majora and meet as a contoured bulb over the fourchette, perineum and the anus; and "Heavy", which is made of the "Full" version, plus has an anal vibrating plug.

The "Lite" version may have the following characteristics:

made from a flexible silicone (durometer 4 to 50) or urethane rubber compound that is appropriate for temporary insertion into the vagina. This material can be clear or opaque or translucent of any colour.

The device may be formed by a molding process so that it is smooth on the outer surface, except where dimpling, texture or many small protrusions are desired to enhance the stimulation effect of the device.

"Lite" version may be composed of three essential parts:

1. One: The clitoral pad is shaped on the inside surface to conform to the female anatomy to best provide contact to the clitoris and surrounding area. It may be oval, round or triangular with smooth rounded edges. The inside surface may be smooth, textured, dimpled or have many small protrusions to enhance the stimulation effect of the device. The clitoral pad is inserted into the clitoral area by parting the labia majora.

2. Because of this unique flexible "U" feature, the device does not require any straps or attachments to hold it in placed. The clitoral pad will stay in place under all reasonable circumstances before, during and after intercourse. It is easily removed by hand when desired. All devices known to the applicant that allow intercourse either attach to the penis to provide vibration stimulation to the woman during intercourse, or they are held above the clitoral area by the means of an undergarment or one or more straps that go around the woman's legs and/or waist.
3. The clitoral pad has at least one vibrating mechanism that can achieve frequencies between 240 and 10,000 RPM. This may be a cylindrical and/or a disk off-centre weight vibrating motor or piezo buzzer. The vibrating mechanism is designed to provide sexual stimulation to the female and also to the male during intercourse or close proximity. The axis of the vibrations may be planar or perpendicular to the inside surface of the clitoral pad. Vibrating mechanism is located inside the clitoral pad and is designed to transmit its vibrations through the pad to the user of the device. The vibrations may be varied in a variety of fashions including intensity, frequency and to set up standing waves and rhythms to increase sexual satisfaction. These vibrations can be controlled with a microprocessor and can be altered by the user selecting various modes of operation. The modes of operation can be pre-programmed or can be modified through the use of a "USB" port from a standard P.C. or radio or I.R. communications or voice or clap.
4. The clitoral pad may or may not have other means of stimulating a human for the purpose of sexual gratification. These means include "electro-stimulation" or "Electrical Neural Stimulation Toy" or "Electro Sex Toy" which is a system that applies a voltage potential between parts of the body and thereby passes electronic current through human tissue. This increases blood flow to the area and causes muscles and tissue to contract for the purpose of pleasure. The nervous system is excited during this electro-stimulation and many people find pleasure in this sensation. Small smooth electrical contact pads can be placed strategically on numerous areas of the device in addition to the clitoral pad to facilitate "electro-stimulation". This allows current flow to be set up between various areas of the clitoral pad, between the pad and internal arm and between the pad and the internal vibration module (described later) and the vibration module and the internal arm. The electronics and microprocessor to drive these "Electro Sex" options can be contained inside the flexible exterior of the device.
5. Other clitoral pad stimulation techniques include mechanical movement. Through mechanical means the bottom surface of the pad can be moved in any of three axis directions and/or can perform a constricting motion where the outside of the pad moves towards the centre and then back out again. This provides a motion the clitoral area that can be back and forth, and/or up and down and/or rotational and/or perceived as pressure changes against the body by moving in an in and out fashion. The movement can be controlled by the microprocessor and perform varied patterns and rhythms in the 6 to 600 Hz. range with an amplitude of up to 0.2". The motion can be achieved through the use of SMA (shape memory alloys) in the multi-layer stacked form of a "Nono muscle" or the SMA spring/piston ("electric piston") or through the heating and cooling of SMA wire (Nitro, Muscle wire or other "Titanium Nickel products") or geared electric motor mechanisms or by solenoid push and/or pull action. The motion can be transmitted to the desired spot on the clitoral pad and/or to other areas of the device through the use of rotating drive shafts, push rods, levers, etc. The mechanical motion is very different to a vibration in that the frequency is much lower and the amount of travel that the pad moves is much larger and the motion can be controlled during the stroke. The stroke length can be varied and the stroke speed can vary during a single cycle of the stroke. This allows many permutations of movement by varying the cycle speed, pause time, stroke acceleration, speed and length of travel (amplitude).
6. Another unique method of producing movement is a "Bent Drive" shaft rotating inside a sheath that can be used to create movement away from the motor and gear train. If the "Bent Drive" shaft is made from a flexible material like TiNi, is driven by a geared motor located above the clitoral pad, and it is rotated internally in the arm of the device, the internal vibrating module can be made to move or flick back and forth as the drive shaft rotates. The spring drive shaft must have a resting shape that has some amount of curve to it. The larger the bend, the more power and torque required to rotate the drive shaft one revolution.
7. Another method of producing pleasing vibration is through the use of harmonics. A unique method has been devices that sets of slowly changing standing waves in the molding material. When two or more vibrating motors are used, the oscillations from each motor combine to cause constructive interference when the motor's off-centre weights are in phase with one another. When the motors' off-centre weights are out of phase with each other, destructive interference is created and the effect is to reduce half the motors' vibrational effect. As the motors are running at very nearly the same RPM, the motors slowly change their relative phase creating a pulsating harmonic between them. These standing waves come and go as the motors come in and out of phase and create a very pleasing harmonic resonance in the molded material. The rhythm of the harmonic is a function of how closely the motor speeds match each other and their absolute RPM. No other device utilizes motors (two or more) to produce harmonic interference based on vibration patterns or effects. Due to electrical feedback, if two or more motors are connected electrically in parallel, the harmonic patterns become significant provided the motors are placed in approximately the same rotational plane and the vibrations from each motor can sufficiently reach the other motor(s). A microprocessor control can also be used to control the speed of the motors and therefore control the nature of the harmonic patterns created through the constructive/destructive interference patterns generated as the motors vibrate.
8. Any method of producing vibration or mechanical movement and be applied to any part of the device of the present invention.
9. No wires are external to the device of the present invention and it is "water resistant" or reasonably "water proof" to allow for use in the shower, bath and for washing.
10. Two: The second component of the "Lite" version is the flexible internal arm that is attached at the back end of the clitoral pad in a smooth and contoured fashion. It is thin and narrow and has rounded edges. It is flexible and curved to fit the shape of a typical woman's body between the clitoris and the vaginal opening. It continues from the vaginal opening in a lesser curved shape for 2 to 3 inches as it is designed to go well into the vagina when the clitoral pad is in place on the woman's body. It is made from the same flexible silicone or rubber that the clitoral pad is made from. Any drive shafts, push/pull rods or wires that go from the clitoral pad to the internal vibrating module are housed internal to the arm. The arm is very soft and flexible on the outside and has a smooth surface. The arm has a springy nature by virtue of internal spring steel or TiNi (titanium nickel compound) rods that are housed inside the silicone rubber. This springy nature allows the arm to flex internally in the woman as she moves and flexes. This allows movement but also applies some force as the arm always wants to maintain to its "C" shape. This force pushes down on the clitoral pad at the top end of the arm, and at the bottom end of the arm, the vibrating module is pulled towards the front of the woman's body where the G-spot is located. The unique aspect of this internal arm is that holds the clitoral pad in place, it holds the internal vibrating module around the G-spot area in the vagina and is flexible enough to adapt to any shape that the vagina may take. In addition it is the only product that is designed to allow the user to have intercourse while wearing the device of the present invention. The penis or other similar shaped objects can easily go into the vagina while the arm is in place. A male will not be bothered by the device as it is being worn by the woman due to its smooth surface and low profile. This is unique in that no other device can hold a vibrating module in the vagina during intercourse.

11. Three: At the end of the arm is an internal vibrating module. It is a round disk shape about 1" in diameter and 0.25" thick. It is smooth and flexible on the outside and is tapered where it attaches to the arm. This vibrating module contains at least one vibrating cylindrical or disk-shaped motor and may also contain electro-stimulation pads. Mechanical movement in addition to vibration may be achieved through the use of drive shafts or push/pull rods housed in the arm. The vibration module could have any combination of movements including rotational, sideways, back and forth or up and down.

The "Medium" version is comprised of the Lite version plus it has a handle, as noted above in reference to FIGS. 6 to 10.

In an alternate version to that described above, mounted centrally on the top side of the clitoral pad is a pedestal. The pedestal rises from the pad in a smooth contoured fashion. This pedestal provides a means of attaching a handle. The pedestal is fashioned in such a way as to allow the labia majora to fold over the clitoral pad and surround the pad expect in a small area in the middle of the pad where the pedestal is attached. The handle is attached to the pedestal in a smooth and contoured fashion and where it is wider than the pedestal, it allows the labia majora to reside between the clitoral pad and the handle. The handle is used by the user to adjust the position of the device and it contains some push buttons imbedded in the soft exterior of the handle. The handle may also contain batteries and/or the device's electronics. The handle is about 1 inch wide, smooth, soft, flexible and is tapered in shape so as to be comfortable when sandwiched between two people.

The "Full" version as shown above in 11*d* (without the internal arm), e and f is composed of the Medium version plus it has two vibrating membrane arms that come from the central part of the "C" and cover the labia majora and meet as a contoured bulb over the fourchette, perineum and the anus. These two arms may each contain at least one vibrating cylindrical or disk shaped motor and may also contain electro-stimulation pads. The arms are elastic in nature to allow for the woman to stretch and move without restriction or discomfort. The arms transmit sensation to the labia majora and surrounding tissues. The arms are about 0.2" thick and may be as wide as 1". They are shaped to allow the penis or other similarly shaped objects to enter the vagina, without restriction. Again, no other device can hold vibrating arms against the female sensitive areas during intercourse, without the use of straps or undergarments. Where the two membrane arms meet above the perineum, there may be at least one vibrating cylindrical or disk-shaped vibrating motor and may also contain electro-stimulation pads. This area is contoured to fit between the cheeks and contact the skin in the area of the anus to transmit the desired vibrations. It is smooth and soft with rounded edges. It will be understood that the "full" version is, essentially, a basic device, as shown in FIGS. 1 to 5, grafted to an additional item of paraphemalia.

The "Heavy" version is comprised of the Full version plus it has an attached anal plug that can be available in several sizes. This anal vibrating plug may contain at least one vibrating cylindrical or disk-shaped vibration motor and may also contain electro-stimulation pads and or mechanical movement facilities described above.

The device may have a memory shape element to it as well—i.e. if you bend it fairly hard, at a certain point it will change its resting shape and remember to a degree. This would allow a user to bend it strategically so that the device is the precise shape they want. The device would still flex as the original "non-customizable, device" does. Normal use does not flex the device enough to cause it to appreciably take on a new shape—i.e. it keeps its shape after adjusting. This can be done by adding a wire or strip or loop of iron or aluminum or other material.

Lite takes lithium batteries CR2450 or CR2032 or AAAA Alkaline.

Parts List for Alternative Version of the "Lite version"

Core of 30 durometer silicone (pink)

Outer surface of 10 durometer silicone (clear or blue)

26 AWG varnished wire 2 miniature circuit boards for battery contacts and wire connections 0.3"*0.6"

1 molded silicone switch cover 2 of coin type vibrating motors part Sanko 1E110-3VDC 2 of AAAA batteries 1.5 volt Alkaline 1 miniature slide switch GC Switch No. 35-202

28 cm of Titanium/Nickel 50/50 wire diameter of 0.026"

FIG. 11*h* illustrates: (i) Operational finished Core with internal motors and switch, (ii) Core mold, (iii) internal TiNi spring and (iv) Outer mold example to demonstrate shape of finished product.

Note the arrows showing the Outer surface "O" and Inner surface "I" in FIG. 11*h*. When worn, the inner surface is against the woman and the outer surface is against the man.

Shape of a possible switch cover (to keep silicone out of switch during molding process) is shown in FIG. 11*i*. Switch mount wings get cut off and switch is sealed inside white silicone cover with silicone glue after wires are attached.

Switch in silicone housing is shown in FIG. 11*j*.

A spring in loop after being cut to 29 cm and made into loop by twisting ends together and holding in place with a small steel clip, as shown in FIG. 11*k*.

FIG. 11*l* illustrates the spring wire in jig showing wire dimensions.

Note Radius A, B and C in FIG. 11*l*. To best fit a woman's body:

Radius A is smallest and blends into B, which blends into the largest radius C. A is about 0.25" radius, B is 0.5" radius, and C is 1.0" radius. H is to show the "Hook" area of the internal vibrating module. This bend starts at post "P". The Hook pulls up on the G-spot and holds the device in place. The up pressure by the hook is countered by downward pressure on the clitoral area.

In FIGS. 11*m* and 11*n*, parts in Core Mold, the scale to the right is in inches. Two motors (8 and 10), spring, circuit board, switch (11) without cover and two AAAA Energizer batteries (16).

Assembly Procedures

Wires are soldered to circuit board 2, switch is soldered to circuit board 1, and wires are soldered to motors as per schematic. Motors are given a thin coat of silicone to make them impermeable during molding process. Switch is sealed into molded, silicone cover with silicone glue also to keep silicone out during molding process. Two AAAA batteries have their positive end bumps filed down flush in order to create two "temporary" batteries that are about 0.08" shorter than normal AAAA batteries. Small pieces of clay are placed on ends of each temporary battery and the circuit board 2 is stuck to one end. Circuit board 1 with mounted and encapsulated switch is pressed into the clay at the other end of the batteries. The wire is made into a loop by cutting a straight piece 29 cm long and twisting the two ends together. The wire is placed in a jig and formed with a heating process to 500° C. for five minutes in order for the spring to maintain the desired shape. The spring is then placed in the core mold. The batteries (with switch and PCB #1 at one end, and PCB #2 at the other end) is placed into the core mold and the two motors with wires running to PCB #2 are placed inside the core mold. Top of mold is pressed in place and the mold is filled with 30 durometer silicone. Once silicone has cured, the core is removed and placed in the outer mold. The outer mold top is pressed into place and is then filled with 10 durometer silicone. Once the silicone has cured the final product is removed from the mold. A blade is used to make one central split, between the batteries on the top surface of the clitoral pad. The short temporary batteries are removed through the slit along with the small bits of clay. The PCB contacts are cleaned and inspected for silicone that could interfere with battery to PCB contact. New AAAA batteries are inserted and the silicone stretches to accept the normal length batteries. The stretch causes the PCBs to be pressed against the ends of the batteries and maintain good electrical contact. The unit is then turned on to ensure both motors operate and any mold flanges are cut off.

The shape and degree of resistance to flexing of the internal arm is critical.

Two elements of TiNi wire between 0.020 and 0.030" diameter offer the correct amount of flexibility. Prototypes created used 0.024, 0.026 and 0.0277". A single strand would need to be about 0.026 to 0.032" in diameter to offer similar stiffness, but two strands were settle on because of the increased lateral stability of the arm, over one thicker spring wire.

The shape of the arm is critical as well so that the arm conforms well to the shape of a woman between the clitoris and the vaginal opening. The clitoral pad is anatomically shaped to ensure it is close filling and it is small enough to nestle in between the outer labia. The arm is thin and narrow in order to be as unobtrusive as possible to the man. The internal vibrating module is curved to put pressure on the G-spot. When the arm is inserted into the vagina, the curve of the arm is spread open and stresses the spring. This exerts pressure downward on the clitoral pad and presses to pad into the woman's clitoral area. An equal force is exerted upwards by the internal vibrating module on the G-spot area in the vagina. The C shape of the device is opened up when it is inserted into the woman and the resulting pressure keeps the device in place during intercourse. The arm is flexible enough to allow movement. As a woman changes body position, the arm flexes and moves and does not exert undesirable pressure internally or externally in the woman. It should be noted also that the device conforms to the shape of the vagina even when this shape changes when a penis is inserted and also changes when the penis is at different angles relative to the woman. The spring is made of a memory material (TiNi) so that no amount of bending will permanently change the relaxed shape of the spring and therefore the shape of the device. Normally, the relaxed "C" shape of the device is opened up to almost an "L" shape when it is worn.

The "inner" surface of the clitoral pad, internal arm and internal vibrating module have a textured (knurled) surface to maximize grip or friction on the woman's skin. This is to help hold the device in place by gripping the woman's skin that it is in contact with.

The "outer" surface of the clitoral pad, internal arm and internal vibrating module that is against the man's skin is glass smooth to minimize friction to reduce any tendancy of the device to move with the man as the penis moves in and out of the vagina.

I claim:

1. A sexual stimulation device to be worn by a woman comprising:

an inner arm having a vaginal wall contacting portion dimensioned to contact a vaginal wall when said inner arm is inserted into a vagina of said woman;

an outer arm having a clitoris contacting portion dimensioned to contact a clitoral area of said woman when said inner arm is inserted into said vagina;

a middle portion connecting the inner arm to the outer arm, and being sized and shaped to permit sexual intercourse when said sexual stimulation device is emplaced on said woman; and an internal skeleton configured to resiliently urge said vaginal wall contacting portion into contact with an anterior surface of said vaginal wall, and to resiliently urge said clitoris contacting portion into contact with said clitoral area when said sexual stimulation device is emplaced on said woman, such that said device is held in place during intercourse.

2. The sexual stimulation device as claimed in claim 1 wherein said middle portion is generally u-shaped in a relaxed position.

3. The sexual stimulation device as claimed in claim 2 wherein said vaginal wall contacting portion and said clitoris contacting portion face toward one another.

4. The sexual stimulation device as claimed in claim 2 wherein said device tapers inwardly from said outer arm to said u-shaped middle portion and then outwardly from said middle portion and said inner arm.

5. The sexual stimulation device as claimed in claim 4 wherein said middle portion has a thickness that is less than a thickness of either of said inner arm and said outer arm.

6. The sexual stimulation device as claimed in claim 4 wherein said middle portion has a width that is narrower than a width of either of said inner arm and said outer arm.

7. The sexual stimulation device as claimed in claim 1 wherein said device is configured to resiliently urge said vaginal wall contacting portion into contact with the anterior surface of said vaginal wall at about a nerve reflex area of the vaginal wall.

8. The sexual stimulation device as claimed in claim 7 wherein said outer arm has a protuberance associated with said clitoris contacting portion.

9. The sexual stimulation device as claimed in claim 7 wherein said device includes a mechanism to cause said device to twitch to vary a contact pressure with said vaginal wall and said clitoral area.

10. The sexual stimulation device as claimed in claim 9 wherein the twitching mechanism comprises a material which changes shape upon the application of a current.

11. The sexual stimulation device as claimed in claim 10 wherein said material is a bimetallic alloy.

12. The sexual stimulation device as claimed in claim 10 wherein the current is applied in a pattern to apply a pattern of twitching.

13. The sexual stimulation device as claimed in claim 1 wherein said internal skeleton is covered by a soft pliable outer layer.

14. The sexual stimulation device as claimed in claim 13 wherein said internal skeleton is made from one or more of a thermoplastic elastomer, a molded nylon or polyurethane.

15. The sexual stimulation device as claimed in claim 13 wherein said soft pliable outer layer is made from an elastomeric material.

16. The sexual stimulation device as claimed in claim 13 wherein said soft pliable outer layer is made from silicone, rubber or vinyl.

17. The sexual stimulation device as claimed in claim 13 further including at least two vibrator means contained within said device, wherein one vibrator means is positioned in each of said inner arm and said outer arm.

18. The sexual stimulation device as claimed in claim 17 further including a power means electrically connected to at least one vibrator means.

19. The sexual stimulation device as claimed in claim 18 wherein said power means comprises at least one battery or a wire.

20. The sexual stimulation device as claimed in claim 19 wherein said at least one battery is one of a rechargeable battery or a disposable battery.

21. The sexual stimulation device as claimed in claim 19 wherein said at least one battery is a rechargeable battery and said device includes a recharging circuit and a recharging outlet.

22. The sexual stimulation device as claimed in claim 21 further including a recharger to connect to said recharging outlet for recharging said at least one battery.

23. The sexual stimulation device as claimed in claim 21 further including an induction charger for recharging said at least one battery.

24. The sexual stimulation device as claimed in claim 18 wherein said vibrator means and said power means are sealed within said pliable outer layer.

25. The sexual stimulation device as claimed in claim 18 further including a switch electrically connected to said power means and said at least one vibrator means to turn said at least one vibrator means on and off.

26. The sexual stimulation device as claimed in claim 25 wherein said switch has multiple settings to vary one or both of a level of power to said at least one vibrator means, or a direction of rotation of said at least one vibrator means.

27. The sexual stimulation device as claimed in claim 13 wherein said soft pliable outer layer is smooth to facilitate wearing of the device during sexual intercourse.

28. The sexual stimulation device as claimed in claim 13 wherein said soft pliable outer layer includes texturing to enhance sexual stimulation.

29. The sexual stimulation device as claimed in claim 28 wherein said texturing is located on said clitoral contacting portion.

30. The sexual stimulation device as claimed in claim 1 wherein said internal skeleton is made from a shape memory alloy.

31. The sexual stimulation device as claimed in claim 30, wherein said shape memory alloy allows a user to bend it strategically so that the device conforms to a desired shape.

32. The sexual stimulation device as claimed in claim 31, wherein said device maintains the desired shape during use.

33. The sexual stimulation device as claimed in claim 13 wherein said soft pliable outer layer includes a re-sealable access means.

34. The sexual stimulation device as claimed in claim 33 wherein said resealable access means is a peel-back layer.

35. The sexual stimulation device as claimed in claim 34 wherein said peel-back layer provides access to at least one replaceable battery in said device.

36. The sexual stimulation device as claimed in claim 33 wherein said resealable access means is a removable plug.

37. The sexual stimulation device as claimed in claim 1, further including at least one vibrator means.

38. The sexual stimulation device as claimed in claim 37 wherein said at least one vibrator means is positioned in one of the inner arm and the outer arm.

39. The sexual stimulation device as claimed in claim 1 wherein said device includes a first vibrator means within said inner arm, a second vibrator means within said outer arm, a power means electrically connected to said vibrator means, and a switch electrically connected between said power means and said first and second vibrator means to control the power to said first and second vibrator means.

40. The sexual stimulation device as claimed in claim 39 wherein said first and second vibrator means vibrate in a harmonic wave pattern when energized.

41. The sexual stimulation device as claimed in claim 40 wherein said harmonic wave pattern can be varied by a user.

42. The sexual stimulation device as claimed in claim 39 wherein said outer arm includes a third vibrator means.

43. The sexual stimulation device as claimed in claim 42 wherein said first, second and third vibrator means vibrate in a harmonic wave pattern when energized.

44. The sexual stimulation device as claimed in claim 43 wherein said harmonic wave pattern can be varied by a user.

45. The sexual stimulation device as claimed in claim 1, wherein said each of said inner arm and said outer arm has a width that tapers down toward said middle portion.

46. The sexual stimulation device as claimed in claim 1, wherein said each of said inner arm and said outer arm has a thickness that tapers down toward said middle portion.

47. A wearable sexual stimulation device comprising:

an inner arm for insertion into a vagina of a wearer, said inner arm having a vaginal wall contacting portion dimensioned to contact a vaginal wall when said inner arm is inserted into said vagina of said wearer;

an outer arm having a clitoris contacting portion dimensioned to contact a clitoral area of said wearer;

a connecting portion extending between said inner arm and said outer arm, said connecting portion having a smaller width than both of said inner arm and outer arm and having a smooth surface; and an internal skeleton configured to resiliently urge said vaginal wall contacting portion into contact with an anterior surface of said vaginal wall, and to resiliently urge said clitoris contacting portion into contact with said clitoral area when said sexual stimulation device is emplaced on said wearer, such that said device is held in place during intercourse.

48. A sexual stimulation device comprising:

an inner arm sized and shaped for insertion into a vagina and having a vaginal wall contacting portion dimensioned to contact a vaginal wall when said inner arm is inserted into said vagina;

an outer arm sized and shaped to contact a clitoral area and having a clitoris contacting portion;

an admittance arm extending between said inner arm and said outer arm, wherein said admittance arm is thin enough to permit said device to be worn by a woman during sexual intercourse; and an internal skeleton configured to resiliently urge said vaginal wall contacting portion into contact with an anterior surface of said vaginal wall, and to resiliently urge said clitoris contacting portion into contact with said clitoral area when said sexual stimulation device is emplaced on said woman, such that said device is held in place during intercourse.

49. A sexual stimulation device comprising:

an inner arm sized and shaped for insertion into a vagina and having a vaginal wall contacting portion dimensioned to contact a vaginal wall when said inner arm is inserted into said vagina;

an outer arm sized and shaped to contact a clitoral area and having a clitoris contacting portion;

an admittance arm extending between said inner arm and said outer arm, wherein said admittance arm is narrow enough to permit said device to be worn by a woman during sexual intercourse; and an internal skeleton configured to resiliently urge said vaginal wall contacting portion into contact with an anterior surface of said vaginal wall, and to resiliently urge said clitoris contacting portion into contact with said clitoral area when said sexual stimulation device is emplaced on said woman, such that said device is held in place during intercourse.

50. A sexual stimulation device to be worn by a woman during sexual intercourse, said device comprising an anatomically shaped body having;

an inner arm for insertion into a vagina for contacting an anterior surface of said vagina;

an outer arm dimensioned to fit within the labia majora for contacting a clitoral area of said woman; and a U-shaped connecting portion to connect said inner arm with said outer arm, said U-shaped connecting portion having a thickness that is less than both of said inner arm and outer arm;

wherein said body further includes (i) a vibration means to cause said body to vibrate, and (ii) an internal core configured to resiliently urge said inner arm into contact with said anterior surface of said vagina, and to resiliently urge said outer arm into contact with said clitoral area when said sexual stimulation device is emplaced on said woman, such that said device is held in place during intercourse.

51. The sexual stimulation device as claimed in claim 50 wherein said internal core is covered by a soft pliable outer layer.

52. The sexual stimulation device as claimed in claim 50 wherein said internal core comprises an internal skeleton having an outer shell portion at one end to retain a vibrator means therein, an inner shell portion at the other end to retain a further vibrator means therein and a resilient portion extending between the inner and outer shell portions.

53. The sexual stimulation device as claimed in claim 52 further including a source of power to power said vibrator means.

54. The sexual stimulation device as claimed in claim 53 wherein said source of power is sealed within said pliable outer layer.

55. The sexual stimulation device as claimed in claim 53 further including wiring between said vibrator means and said source of power wherein said wiring is at least partially contained within said internal skeleton.

56. The sexual stimulation device as claimed in claim 52 wherein said inner and outer shell portions extend at least partially around said respective vibrator means.

57. The sexual stimulation device as claimed in claim 50, wherein said inner arm has an inner surface and an outer surface, said inner surface contacting said anterior surface of said vagina, and wherein at least a portion of said outer surface of said inner arm is substantially flat relative to the inner surface of said inner arm.

58. The sexual stimulation device as claimed in claim 57, wherein said outer surface of said inner arm is smooth.

59. A sexual stimulation device to be worn by a woman comprising:

an inner arm having an inner surface and an outer surface, a portion of said inner surface being dimensioned to contact a vaginal wall when inserted into a vagina of said woman;

an outer arm having an inner surface and an outer surface, a portion of said inner surface being dimensioned to contact a clitoral area of said woman when said inner arm is inserted into said vagina;

a middle portion connecting the inner arm to the outer arm, said middle portion having a width that is less than the width of said inner arm and said outer arm; and an internal skeleton configured to resiliently urge said portion of said inner surface of said inner arm into contact with an anterior surface of said vaginal wall, and to resiliently urge said portion of said inner surface of said outer arm into contact with said clitoral area when said sexual stimulation device is emplaced on said woman, such that said device is held in place during intercourse.

60. The sexual stimulation device of claim 59, wherein said middle portion has a thickness that is less than the thickness of said inner arm and said outer arm.

61. The sexual stimulation device of claim 59, wherein said middle portion has a width that is greater than its thickness.

62. The sexual stimulation device of claim 59, wherein said inner surface of said inner arm tapers to increase thickness from said middle portion.

63. The sexual stimulation device of claim 59, wherein said outer surface of said inner arm is generally flat as compared to said inner surface of said inner arm.

64. The sexual stimulation device of claim 59, wherein said inner surface of said outer arm is textured where said outer arm contacts said clitoral area of said woman.

65. The sexual stimulation device of claim 59, wherein said inner surface of said inner arm is textured where said inner arm contacts said vaginal wall.

66. A sexual stimulation device comprising:

an inner arm sized and shaped to have an inner end contact a vaginal wall when said inner arm is inserted into a vagina of a woman;

an outer arm sized and shaped to contact a clitoral area of said woman when said inner arm is inserted into said vagina;

a middle portion connecting the inner arm to the outer arm, the middle portion having a thickness that is less than both of said inner arm and said outer arm; and an internal skeleton configured to resiliently urge said inner end of said inner arm into contact with an anterior surface of said vaginal wall, and to resiliently urge said outer arm into contact with said clitoral area when said sexual stimulation device is emplaced on said woman, such that said device is held in place during intercourse.

67. The sexual stimulation device as claimed in claim 66 wherein said middle portion has a width that is narrower than a width of either of said inner arm and said outer arm.

* * * * *